US009054447B1

(12) United States Patent
Czarnecki

(10) Patent No.: US 9,054,447 B1
(45) Date of Patent: Jun. 9, 2015

(54) ELECTRICAL CONNECTOR USING AIR HEATED BY AN ELECTRICAL ARC DURING DISENGAGEMENT OF CONTACTS TO EXTINGUISH THE ELECTRICAL ARC

(71) Applicant: Reliance Controls Corporation, Racine, WI (US)

(72) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 14/079,739

(22) Filed: Nov. 14, 2013

(51) Int. Cl.
*H01R 13/53* (2006.01)

(52) U.S. Cl.
CPC ..... *H01R 13/53* (2013.01)

(58) Field of Classification Search
CPC ..... H01R 13/53; H01R 13/6485
USPC ..... 439/181–187
See application file for complete search history.

(56) References Cited

U.S. PATENT DOCUMENTS

| | | | | | |
|---|---|---|---|---|---|
| 1,521,903 | A | | 1/1925 | Mueller | |
| 1,531,049 | A | | 3/1925 | Thompson | |
| 1,965,151 | A | | 7/1934 | Mueller | |
| 2,373,070 | A | | 4/1945 | Wulstein | |
| 3,542,986 | A | * | 11/1970 | Kotski | 218/90 |
| 3,605,066 | A | | 9/1971 | Vierck et al. | |
| 3,703,621 | A | | 11/1972 | Viola et al. | |
| 3,739,122 | A | * | 6/1973 | Pierzchala | 218/15 |
| 3,763,461 | A | * | 10/1973 | Kotski | 439/185 |
| 3,980,377 | A | | 9/1976 | Oxley | |
| 4,233,480 | A | | 11/1980 | Hruda | |
| 4,266,210 | A | | 5/1981 | Mrenna et al. | |
| 4,355,262 | A | | 10/1982 | Chan et al. | |
| 4,375,021 | A | | 2/1983 | Pardini et al. | |
| 4,426,562 | A | | 1/1984 | Kemeny | |
| 4,458,121 | A | | 7/1984 | Yanabu et al. | |
| 4,552,425 | A | | 11/1985 | Billman | |
| 4,733,032 | A | | 3/1988 | Pardini | |
| 4,892,492 | A | | 1/1990 | Mueller | |
| 4,962,406 | A | | 10/1990 | Walker et al. | |
| 4,964,807 | A | | 10/1990 | Draus | |
| 5,138,122 | A | | 8/1992 | Moldovan et al. | |
| 5,277,605 | A | * | 1/1994 | Roscizewski et al. | 439/184 |
| 5,342,226 | A | | 8/1994 | Hayes et al. | |
| 5,427,552 | A | | 6/1995 | Zielinski et al. | |
| 5,433,629 | A | | 7/1995 | Yagi et al. | |
| 5,463,199 | A | | 10/1995 | Divincenzo et al. | |
| 5,645,459 | A | | 7/1997 | Fitting | |
| 5,818,003 | A | | 10/1998 | Moldovan et al. | |
| 5,837,953 | A | | 11/1998 | Ito et al. | |

(Continued)

*Primary Examiner* — Chandrika Prasad
(74) *Attorney, Agent, or Firm* — Boyle Fredrickson, S.C.

(57) ABSTRACT

An electrical connector system is configured for extinguishing a DC arc without the need for externally-driven forces by utilizing the mechanical action of a contact being removed from a pressurized cavity and releasing a flow of air to extinguish the arc. A female connector is disposed within an air-tight cavity. The male connector is removably inserted into the air-tight cavity, sealing the cavity, and providing an electrical connection. When the male connector separates from the female connector, a DC arc is created. However, the male connector continues to restrict air flow into or out of the cavity. The temperature rise within the cavity causes a pressure build-up and the eventual removal of the male connector from the cavity forcefully releases a blast of pressurized air through a constricted opening and extinguishes the arc.

18 Claims, 5 Drawing Sheets

(56) References Cited

U.S. PATENT DOCUMENTS

| | | | | |
|---|---|---|---|---|
| 5,866,864 | A | 2/1999 | Mody et al. | |
| 5,938,485 | A | 8/1999 | Hotea et al. | |
| 6,000,974 | A | 12/1999 | Hotea | |
| 6,056,604 | A | 5/2000 | Roy et al. | |
| 6,089,929 | A | 7/2000 | Sloey | |
| 6,171,155 | B1 | 1/2001 | Miwa et al. | |
| 6,290,533 | B1 | 9/2001 | Major | |
| 6,428,365 | B1 | 8/2002 | Yamamoto | |
| 6,838,632 | B1 | 1/2005 | Via et al. | |
| 7,014,516 | B2 | 3/2006 | Yang | |
| 7,150,660 | B2 | 12/2006 | Allgood et al. | |
| 7,259,646 | B2 | 8/2007 | Rab et al. | |
| 7,374,460 | B1 | 5/2008 | Hariharesan et al. | |
| 7,530,855 | B2 | 5/2009 | Hariharesan et al. | |
| 7,619,177 | B2 | 11/2009 | Saxl et al. | |
| 7,679,020 | B2 | 3/2010 | Schulz et al. | |
| 7,942,683 | B2 * | 5/2011 | Copper et al. | 439/187 |
| 8,222,983 | B2 | 7/2012 | Zhou et al. | |
| 8,319,136 | B2 | 11/2012 | Byron et al. | |
| 8,333,622 | B2 | 12/2012 | Blasko et al. | |
| 2003/0052091 | A1 | 3/2003 | Hillebrand et al. | |
| 2011/0253676 | A1 | 10/2011 | Noisette et al. | |
| 2012/0115351 | A1 | 5/2012 | Bihrer et al. | |
| 2013/0037520 | A1 | 2/2013 | Noisette et al. | |
| 2013/0037521 | A1 | 2/2013 | Noisette et al. | |
| 2013/0082034 | A1 | 4/2013 | Foret | |

* cited by examiner

ELECTRICAL CONNECTOR USING AIR HEATED BY AN ELECTRICAL ARC DURING DISENGAGEMENT OF CONTACTS TO EXTINGUISH THE ELECTRICAL ARC

BACKGROUND OF THE INVENTION

The present invention relates to a means to extinguish an electric arc in a separable electrical contact, and more particularly, pertains to a plug or connector system for extinguishing a direct current arc without the need for an auxiliary arc-extinguishing device or mechanism.

An electric arc is a visible, luminous plasma discharge between two electrodes that is caused by an electrical current ionizing gas in the air and jumping the gap in a circuit or between two electrodes. Any time electrical contact points are opened and closed, which is common in, for example, electrical switches, electrical circuit breakers, and other electrical contact points, they become susceptible to electric arcs. While these arcs are sometimes harnessed for useful purposes such as for heating furnaces, welding, arc lamps, and illumination in spotlights, unwanted arcs may pose a dangerous risk. For example, unwanted electric arcs may cause intense heat and electric sparks, which could potentially start a fire.

An electric are may be created by both alternating current (AC) and direct current (DC) circuits. When electrical contacts carrying AC or DC are drawn apart, strong electric forces draw electrons from one electrode to the other, and an arc is created. Extinguishing an AC arc is relatively simple compared to extinguishing a DC arc. When contacts transmitting AC are parted, an AC arc is created but quickly extinguished by virtue of the next voltage zero that occurs when the electric charge reverses direction. However, rupturing a DC arc is more difficult since the electric charge is unidirectional and there are no zero voltages to automatically extinguish the arc.

Various methods for extinguishing a DC arc have been attempted in the prior art. Some of these methods utilize a magnetic coil or permanent magnet to interact with the arc, taking advantage of the arc's magnetic properties. For example, blowout coils may be used to stretch the arc column until the arc ruptures. Or, a magnetic blast may be used to quickly extinguish the arc in a single blow. However, these magnetic methods are only successful at relatively high current levels, and the requisite amplitude of the magnetic fields generally requires very strong magnets, for example, expensive rare-earth magnets such as $Sm_2Co_{17}$ or NdFeB. In an alternative method, the arc may be immersed in transformer oil, dielectric gas, or a vacuum to suppress or quench the are. Other known methods utilize basic mechanical means, such as blades, knives, or even 12-gauge shotgun shell blasts to extinguish the arc. However, these demanding methods rely upon external sources that are expensive and inconvenient to use.

With the current existing methods, externally derived forces are needed to extinguish the DC arc, whether magnetic, mechanical, or otherwise. The present invention seeks to improve upon such prior art by providing a means to extinguish a DC arc in a separable electrical contact without the need for externally-derived forces in a method integrated with the connector apparatus itself.

Additional features of the present invention seek to facilitate the extinguishment of a DC arc by limiting arc formation to discrete locations of contact between connectors. Also, a safe and inexpensive means which does not reply upon external components is desired.

SUMMARY OF THE INVENTION

The subject matter disclosed herein relates to an apparatus for extinguishing a DC arc in a separable electrical contact. The electrical contact arrangement includes a male contact, a female contact, and a female contact housing. The female contact housing has an internal cavity within which the female contact is contained. The female housing also has a narrow passage that extends from an outer end of the cavity to an exterior surface defined by the housing.

The female contact is configured to couple with the male contact. The female contact has an open outer end portion located toward an outer end of the cavity adjacent the passage and configured to receive the male contact.

The male contact is movable inwardly through the passage for engagement with the open outer end portion of the female contact and movable outwardly through the passage upon disengagement with the open outer end of the female contact. The narrow passage of the female housing has a cross-section defining an area configured similarly to and only slightly larger than a cross-section defined by the male contact, to define a constriction within the passage when the male contact is present within the passage.

In the event an electrical arc is created by disengagement of the male contact with the open outer end of the female contact, air contained within the internal cavity is heated by the electrical arc and high pressure is created within the internal cavity. Such pressurized air is generally maintained in the cavity and the passage while the male contact is present within and being withdrawn from the passage. Immediately upon the end of the male contact being fully withdrawn from the passage, air pressure within the cavity forces air outwardly through the constriction in the passage in a burst that extinguishes the electrical arc.

According to one embodiment of the invention, the female contact is a female receptacle constructed to allow a male contact prong or blade to fit snugly therein. The female receptacle may be an undulating connector providing contact points with the male contact at discrete locations, e.g., two discrete contact points, as disclosed in copending application Ser. No. 13/325,470 filed Dec. 14, 2011 entitled "High Current Female Contact Assembly", the entire contents of which are hereby incorporated by reference.

In yet another embodiment of the invention, a method of extinguishing an electrical arc in an electrical connector arrangement is disclosed. The electrical connector arrangement includes a male contact, a female contact configured to couple with the male contact and having an open outer end portion, and a female contact housing having an internal cavity within which the female contact is contained. The method involves employing a narrow passage that extends from an outer end of the cavity to an exterior surface defined by the housing, and which has a cross-section that corresponds to and is only slightly larger than that of the male contact. The male contact is moved inwardly through the passage into engagement with the open outer end portion of the female contact, and is contained within the cavity along with a quantity of air. When the male contact is withdrawn from engagement with the female contact, the male contact is disengaged from the open outer end of the female contact, which creates an electrical arc. Air contained within the internal cavity is heated by the electrical arc and high pressure is created within the internal cavity. The male contact is then moved outwardly through the passage upon disengagement with the open outer end of the female contact. As soon as the end of the male contact clears the opening of the passage onto the exterior of the housing, pressurized air is forced outwardly through the passage in a violent, turbulent burst that extinguishes the electrical arc.

These and other features and aspects of the present invention will be better appreciated and understood when considered in conjunction with the following description and the accompanying drawings It should be understood, however, that the following description, while indicating a representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
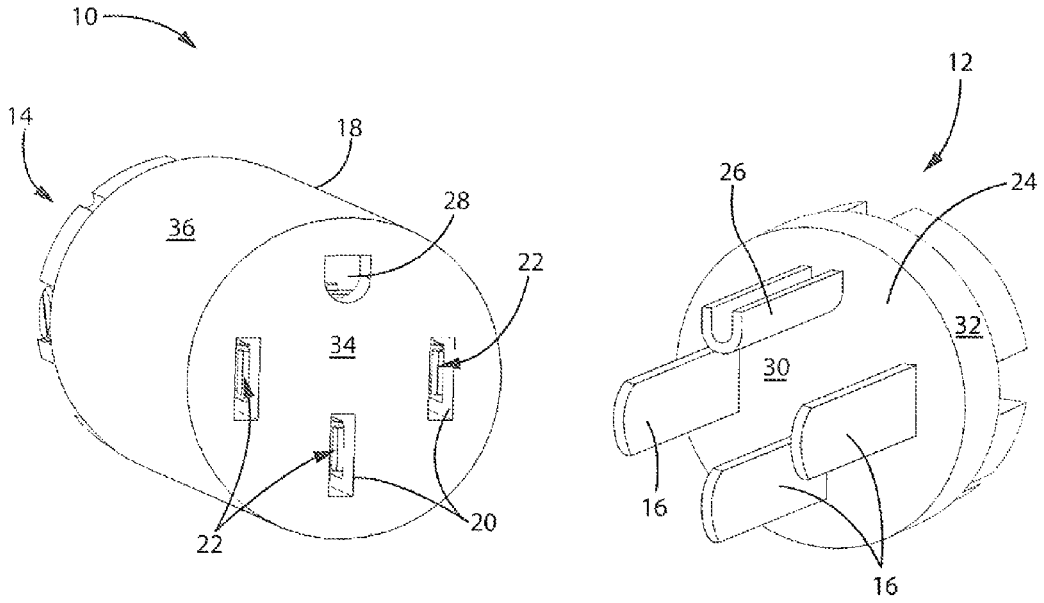
FIG. 1 is an isometric view of a connector system in accordance with the present invention, showing a plug and a socket separated from each other.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DETAILED DESCRIPTION OF THE DRAWINGS

The various features and advantageous details of the subject matter disclosed herein are explained more fully with reference to the non-limiting embodiment described in detail in the following description.

This invention relates to a means to extinguish an electric arc in a separable electrical contact arrangement, and more particularly, pertains to a plug or connector system for extinguishing a DC arc without externally-driven forces by utilizing the mechanical action of a contact being removed from a pressurized cavity and releasing a blast of air to extinguish the arc.

Referring to FIG. 1, one embodiment of a separable electrical connector system 10 in accordance with the present invention includes a plug 12 and a mating socket 14. Typically, the plug 12 is provided at an end of a power cord, the opposite end of which is connected to an electrically powered device, as is known. The socket 14 may be a wall socket or may be a socket associated with a power cord, also in a manner as is known. While illustrated as the plug 12 and mating socket 14, the connector system 10 may be used in any electrical power connection arrangement that utilizes a removable connector for supplying electrical power from a power source.

Figure 2:
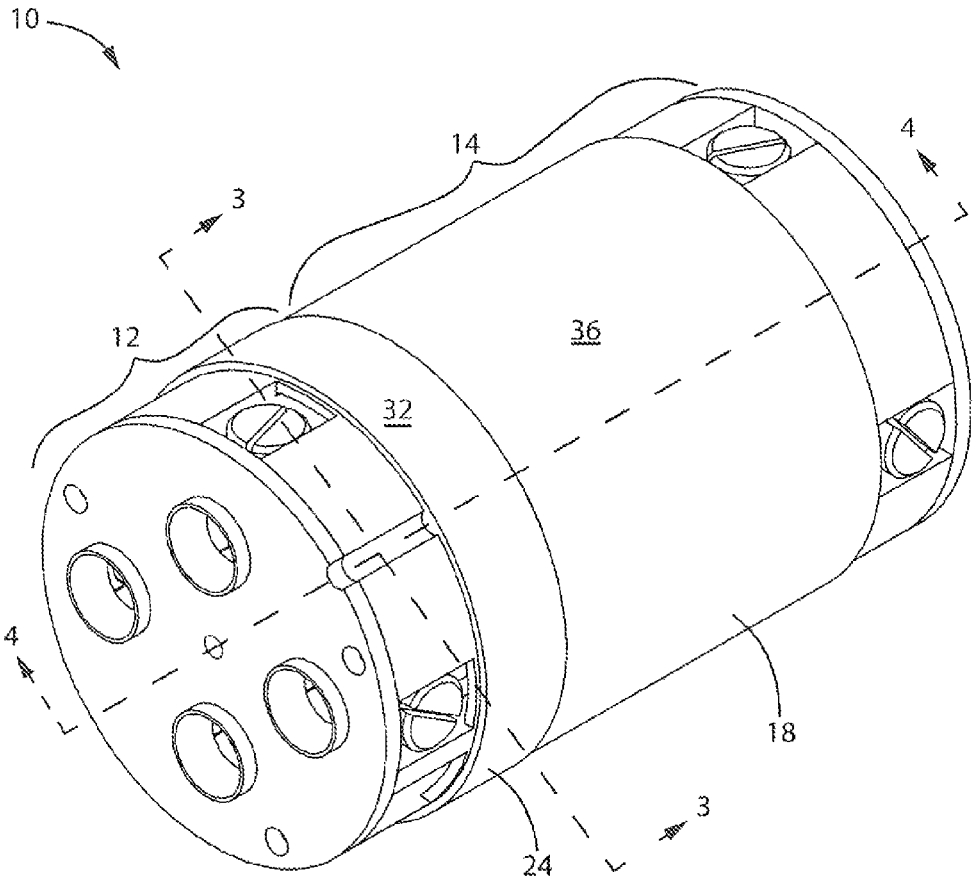
FIG. 2 is an isometric view of the connector system of FIG. 1 showing the plug coupled to the socket.

When the plug 12 and mating socket 14 are separated, as illustrated in FIG. 1, no electrical power transfer may occur. Conversely, when the plug 12 and mating socket 14 are coupled together, as seen in FIG. 2, electrical power transfer is permitted, as generally known in the art.

Figure 3:
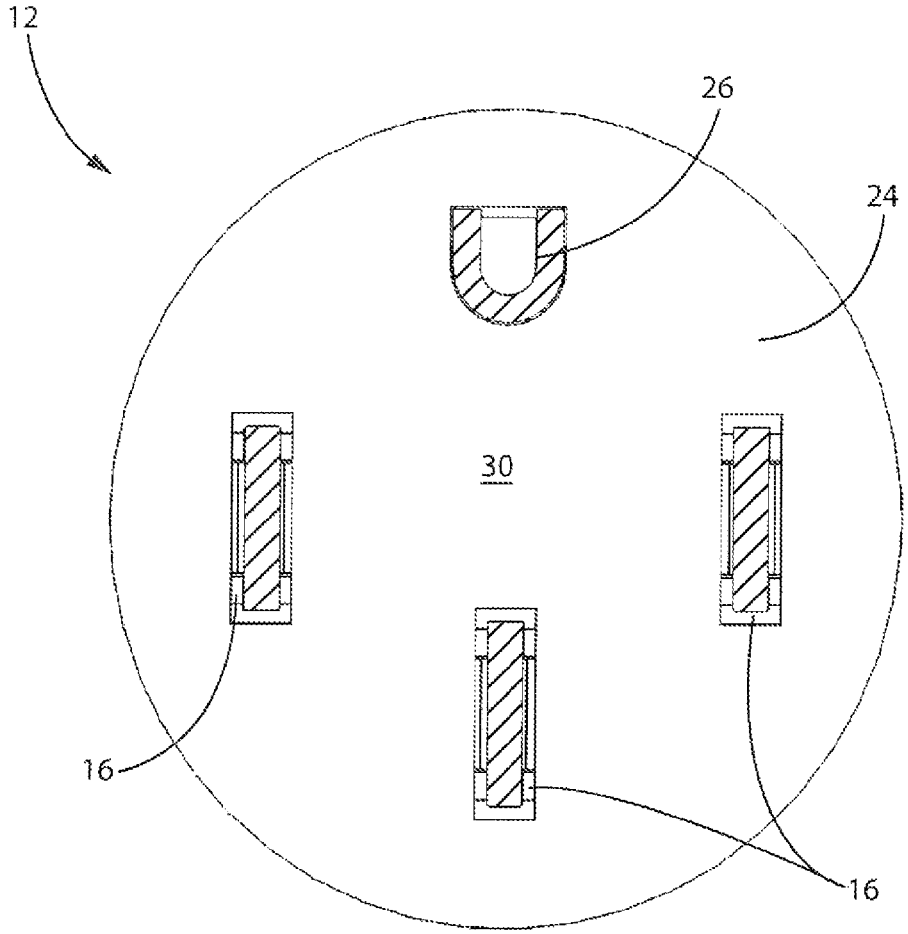
FIG. 3 is a section view taken along line 3-3 of FIG. 2.

Referring to FIGS. 1 and 3, the plug 12 may have pins or prongs 16 that are sized to be inserted into openings 20 of the mating socket 14. The prongs 16 generally extend outwardly from a base 24 which allows the user to safely handle the plug 12. The base 24 may be defined by a generally circular face 30 having sidewalls 32 extending rearwardly therefrom and forming a body that can be grasped by a user. The base 24 may be made of any non-conducting material so as to not allow electrical current to travel through the base 24, in a manner as is known. In particular, the material may be a plastic or rubber material, although it is understood that any material may be used. The base 24 is shown as cylindrical in shape but may take any shape or size as desired.

The prongs 16 may be any desired number and have any desired configuration or orientation. For example, the plug 12 may have four prongs 16 arranged in a circular orientation as shown, for transferring three-phase electrical power. Alternatively, the plug 12 may have three prongs 16 arranged in a circular or T-shape formation, or two prongs 16 arranged side by side as is commonly known. The prongs 16 may also be any shape and size, and may be any combination of flat blades, round pins or other shaped prongs. As illustrated, three of the prongs 16 may be shaped as flat blades, while the fourth prong may be shaped in a u-shape to function as a grounding prong 26. The grounding prong 26 is connected to the earth to protect against insulation failure of the connected device. It is contemplated that the prongs may take different shapes associated with other functions, such as acting as a locking prong with a locking protrusion to secure the prongs 16 to the mating socket 14 by, e.g., a twist feature, or serving as a neutral prong to serve as a return path for the current. The prongs 16 are generally made of a conducting material such as copper or brass, although it is understood that any material may be used. Disposed within the base 24 is the necessary wiring and electrical circuitry (not shown) coupled to the prongs 16 to deliver electricity therethrough, and the rear of the base 24 may be connected to a cord or cable (not shown) that carries wiring for delivering the electrical power, as is generally known in the art.

Referring again to FIG. 1, the socket 14 may have a housing 18 which includes openings 20 allowing passageway to an interior cavity of the housing 18. The housing 18 may be defined by a generally circular face 34 having sidewalls 36 extending rearwardly therefrom and defining a body. The sidewalls 36 extend a length greater than the length of a female contact or receptacle arrangement 22 disposed within, as will be described further herein. The housing 18 may be constructed of a non-conducting material which provides for safe handling of the socket 14. In particular, the material may be a plastic or rubber material, as is known. The housing 18 is illustrated as cylindrical in shape to correspond to the shape of the base 24 of the plug 12, but may take any shape and size. It is also understood that the housing 18 may be a part of a wall-mounted receptacle arrangement, in a manner as is known. The openings 20 are disposed within the circular face 34 of the housing 18 and sized to allow the prongs 16 of the plug 12 to fit therethrough.

Figure 4:
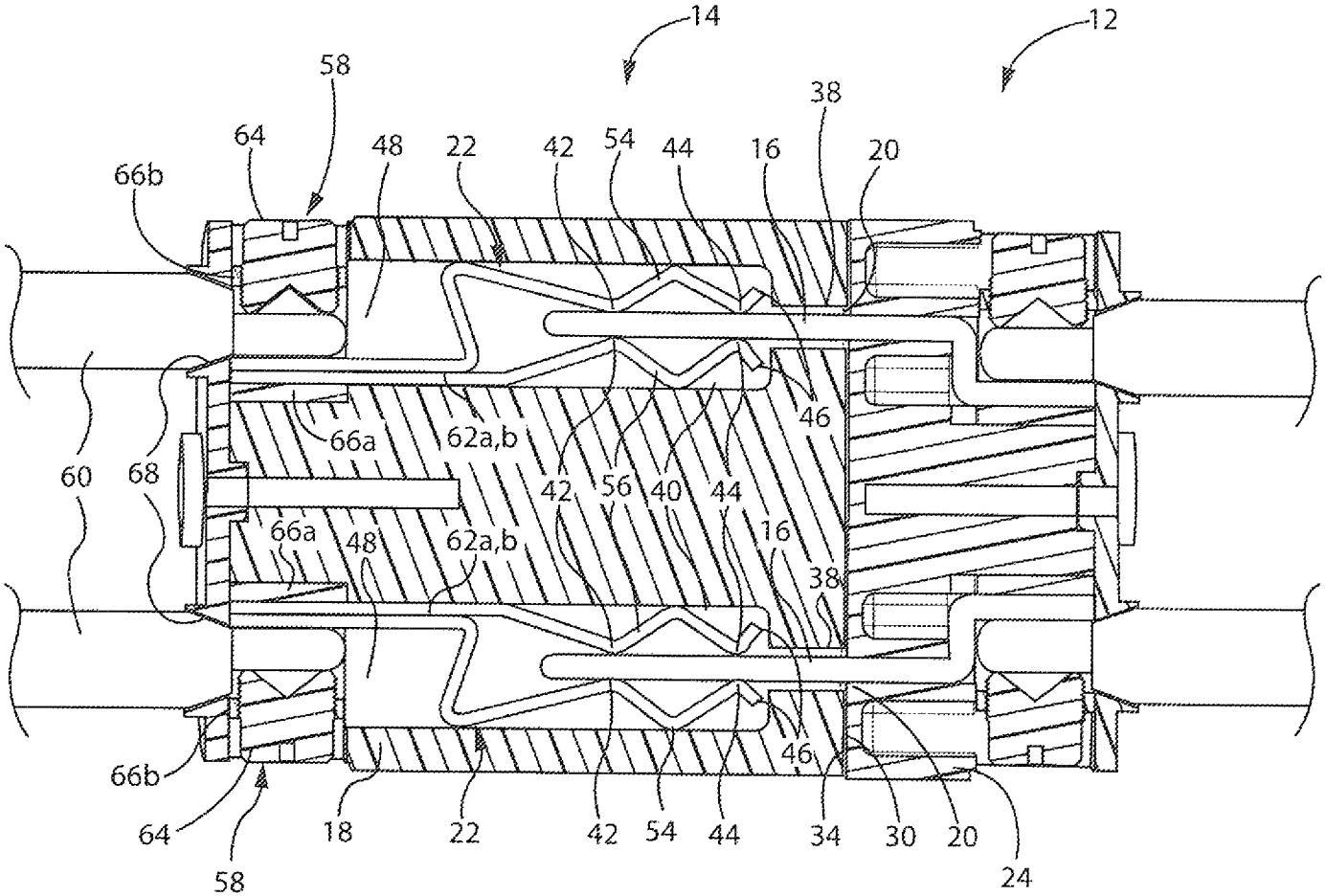
FIG. 4 is a section view taken along line 4-4 of FIG. 2, showing the male plug fully coupled to the female receptacle.

As seen in FIG. 4, the openings 20 of the housing 18 define entrances to narrow passages 38 which extend to the cavity 40. The cross sectional area of an opening 20 is substantially the same size as the cross sectional area of the passage 38. The narrow passage is sized just larger than the prong 16 to be inserted therein, thus nearly providing a nearly air-tight plug when the prong 16 is inserted therein. The narrow passage 38 extends a length so as to constrict the air flowing outward through the passage 38, for reasons to be explained.

The narrow passage 38 passes into a larger cavity 40 having a greater cross-sectional area than the cross-sectional area of the narrow passage 38. The cavity 40 extends rearwardly toward the back end of the housing 18 and is sealed substantially airtight to prevent air flow at all areas of the cavity 40 except for the opening provided by passage 38. The cavity 40 is generally rectangular in shape and sized to receive female receptacle arrangement 22.

As noted, the cavity 40 is sized to hold the female receptacle arrangement 22 therein. While the female receptacle arrangement 22 may take any form which allows a connection with the prongs 16, the female receptacle arrangement 22 is illustrated as dual undulating contacts which make electrical contact with the prongs 16 at four discrete locations. The dual undulating contacts in accordance with the present invention are described in copending application Ser. No. 13/325,470 filed Dec. 14, 2011 entitled "High Current Female Contact Assembly", the entire contents of which are incorporated by reference as noted above.

The dual undulating contacts include two undulating conductive elements 54, 56 having outer ends that define an open area 46 adjacent to the passage 38 and opening 20 to receive the prongs therebetween, and joining together at a back end 48 of the cavity 40 to connect to line connections associated with the socket 14 as is commonly known. The female receptacle arrangement 22 generally extend the substantial length of the cavity 40 but it is understood that they may extend forwardly toward the passage 38 any distance within the cavity 40 permitting contact with the prongs 16.

To connect the conductive elements 54, 56 to line connections associated with the socket 14, a screw terminal 58 is configured to electrically couple an electrical conductor 60, shown as a wire, with the conductive elements 54, 56. The electrical conductor 60 may be part of or connected to an electrical circuit as is commonly known. The electrical conductor 60 may, for example, extend from surrounding insulation that substantially fills an entire area of an opening 68 at the back end 48 of the cavity so as to prevent airflow into or out of the cavity 40 through the opening 68. It is contemplated that the electrical conductor 60 may be a wire coated with an insulator exteriorly of the cavity 40 and at the opening 68, and stripped from insulation inside the cavity 40 to facilitate coupling with a fastener 64, as will be explained.

The conductive elements 54, 56 contain flat segments 62*a*, 62*b* toward the back end 48 of the cavity 40 which are stacked one on top of the other and are at least partially received within the screw terminal 58. The stacked flat segments 62*a*, 62*b* abut against an inner sidewall 66*a* of cavity 40 so as to be partially secured within screw terminal 58. The fastener 64 has external threads that engage matching internal threads formed in an inner sidewall 66*b* so that the end of fastener 64 forces the conductor 60 against the flat segments 62*a*, 62*b* when screw 64 is advanced, to establish a conduct path between flat segments 62*a*, 62*b* and conductor 60.

Referring to FIGS. 2 and 3, when electrical power transfer is desired, the plug 12 is coupled to the socket 14 as shown. In particular, the prongs 16 of the plug 12 are inserted through the openings 20 of the socket 14. The prongs 16 are aligned to fit within the correspondingly shaped openings 20 of the socket 14. For example, the grounding prong 26, which may exhibit a different shape from the remaining prongs 16, is inserted into an opening 28 having a shape corresponding to the grounding prong 26. The prongs 16 are inserted and moved rearwardly toward the back end 48 of the cavity 40 to be disposed within the housing 18.

As seen in FIGS. 2 and 4, the plug 12 and socket 14 are similarly shaped and allow a flush engagement between the circular face 34 of the socket 14 and the circular face 30 of the plug 12 when coupled together. Therefore, the full extended length of the prongs 16 is able to enter the housing 18 when the faces 34, 30 are flush with each other.

As illustrated in FIG. 4, when the prongs 16 are fully coupled with the female receptacle arrangement 22, the prongs 16 contact the female receptacles 54, 56 at two outer contact points 44 located adjacent to the mouth of the opening 20 and two inner contact points 42 located rearwardly from the mouth of the opening 20 and approximately halfway within the length of the cavity 40. However, it is contemplated that the contact points 44, 42 may be at any location within the cavity 40. Also, any number of contact points may be provided. When plug 12 is coupled to socket 14, electrical power flow is permitted, as commonly known.

Figure 5:
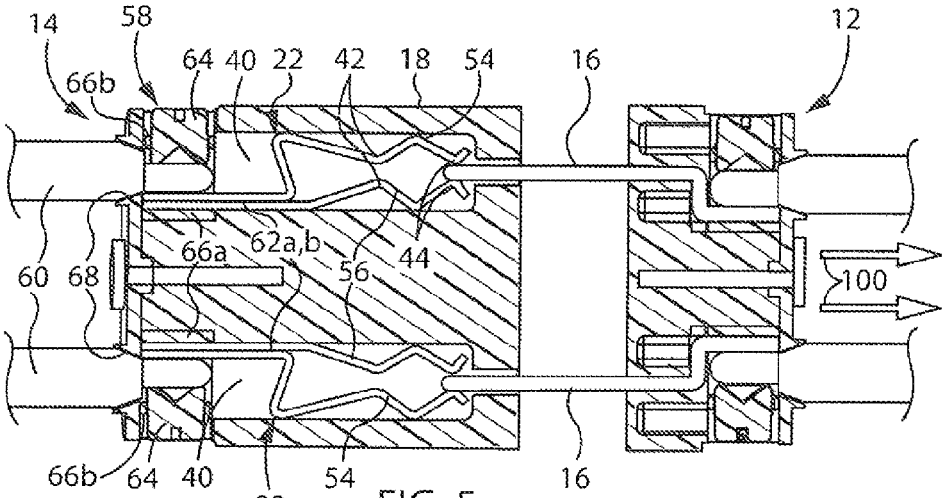
FIG. 5 is a partial section view similar to FIG. 4, showing the plug separating from the socket and the male plug partially coupled to the female receptacle.
Figure 6:
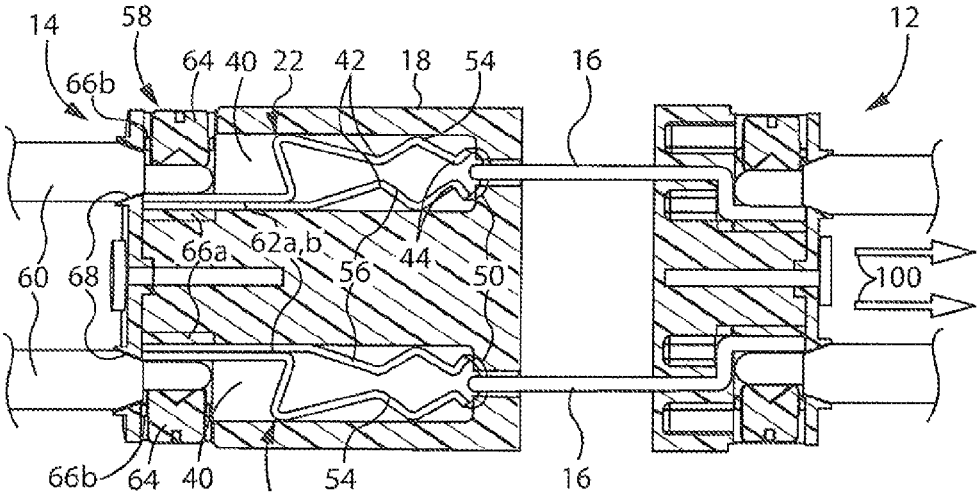
FIG. 6 is a partial section view similar to FIGS. 4 and 5, showing the plug continuing to separate from the socket and the male plug separated from the female receptacle but disposed within the mouth of the socket, with an electrical arc bridging the space between the end of the male plug and the end of the female receptacle.
Figure 7:
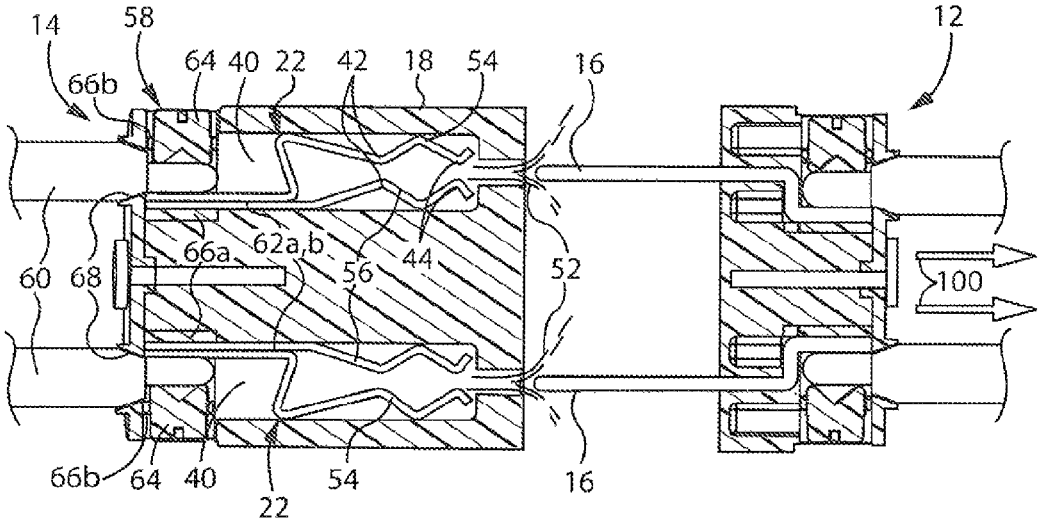
FIG. 7 is a partial section view of the connector system of FIG. 2 showing the plug fully separated from the socket.

Referring to FIGS. 5 and 6, upon the separation of the plug 12 and socket 14, it is expected that an electric arc, e.g., DC arc, may develop and bridge the space between the outer contact points 44 of the female receptacle arrangement 22 and the outer ends of the prongs 16. As seen in FIG. 7, the action of removing the plug 12 from the socket 12 extinguishes the electric arc by operation of the present assembly, as will be explained.

Referring now to FIG. 5, as the plug 12 is separated from the socket 14 in a direction associated with arrows 100, the prongs 16 also disengage from the female receptacle arrangement 22 in a progressive manner. First, the prongs 16 disengage from the two inner contact points 42, while the two outer contact points 44 remain engaged. At this stage of separation, the entire electrical load is carried by the outer contact points 44 only.

Referring next to FIG. 6, as the plug 12 is further separated from the socket 14 in a direction associated with arrows 100, the prongs 16 are disengaged from the two outer contact points 44, as well as remaining disengaged from the two inner contact points 42. At the precise moment in which the prongs 16 separate from the female receptacle arrangement 22, electric arcs 50 may be created at each "pole" of approximately 20,000 degrees K (four times hotter than the surface of the sun). The intense heat produced by the arcs 50 raises the temperature within the cavity 40, causing the air within the cavity 40 to expand. In the position illustrated in FIG. 6, the prongs 16 remain within the constricted passage 38 to act as a plug at the mouth of the opening 20 and prevent air from entering and exiting the cavity 40. This causes an accumulation of expanded air within the cavity 40 and an intense pressure increase within the cavity 40.

The user then continues to withdraw the prongs 16 from the female receptacle arrangement 22. At the same time, the pressurized air within cavity 40 acts on the end of each prong 16 to create an outward force that functions to urge the prong 16 outwardly. Referring next to FIG. 7, as the plug 12 is fully withdrawn from the socket 14 in a direction associated with arrows 100, the highly pressurized heated air is released from within the cavity 40. A blast of pressurized air, represented at 52, is forced outwardly from within the cavity 40 and escapes violently through the opening 20, rupturing the electrical arcs 50. Therefore, the arcs 50 are extinguished at the instance of prong 16 removal and eliminate the risks associated with unwanted electric arcs. The air blast has an extremely short duration since, once the prongs 16 are removed from within the openings 20, the passages 38 are no longer constricted and air pressure within cavities 40 quickly returns to ambient.

While it is shown that each prong 16 of the plug 12 is inserted into its own individual cavity 40, it is appreciated that the prongs may be inserted into separate passages 38 which converge into a common cavity. However, the same constriction of air in the common cavity would occur, and removal of the prongs 16 from their respective passages 38 would release the pressurized air 52 and extinguish the arcs 50. It is also appreciated that the cavity 40 may vary in size and is not necessarily larger than the passage 38 but large enough to carry the female receptacle arrangement 22 so that the prongs 16 may couple therewith.

It can thus be appreciated that the present invention provides a means to extinguish a DC arc without externally derived forces, and only requires the mechanical action of removing a male connector (i.e., prongs 16) from a female connector (i.e., female receptacle arrangement 22). Specifically, the connector system contemplates that the female connectors 22 are held within an air-tight cavity 40 so that insertion of the male connector 16 constricts the air within the cavity 40. Then, as soon as separation of the female connectors 22 from the male connector 16 creates an electric arc 50, pressure builds up within the cavity 40 due to the temperature rise from the arcs 50. Removal of the male connector 16 from the cavity 40 proceeds to forcefully release pressurized air 52 from the cavity 40 in a blast and extinguish the arc 50. Therefore, no external components are necessary to extinguish the arc 50, and extinguishment is done quickly and easily in the same action that creates the arc 50 in the first place.

Various alternatives and embodiments are contemplated as being within the scope of the following claims, which particularly point out and distinctly claim the subject matter regarded as the invention.

I claim:

1. An electrical connector comprising:

a male contact;

a female contact configured to couple with the male contact; and a female contact housing having an internal cavity within which the female contact is contained, and further having a passage that extends from an outer end of the cavity to an exterior surface defined by the housing;

wherein the female contact has an open outer end portion located toward an outer end of the cavity adjacent the passage and configured to receive the male contact, wherein the male contact is movable inwardly through the passage for engagement with the open outer end portion of the female contact and is movable outwardly through the passage upon disengagement with the open outer end of the female contact; and wherein the passage has a cross-section defining an area configured similarly to and slightly larger than a cross section defined by the male contact to define a constriction within the passage when the male contact is present within the passage wherein in the event an electrical arc is created by disengagement of the male contact with the open outer end of the female contact, air contained within the internal cavity is heated by the electrical arc and creates pressure within the internal cavity that forces air outwardly through the constriction in the passage to extinguish the electrical arc.

2. The electrical connector of claim 1 wherein the female contact is a female receptacle constructed to allow the male contact to fit snugly therein.

3. The electrical connector of claim 2 wherein the female receptacle is an undulating connector providing contact points at discrete locations.

4. The electrical connector of claim 3 wherein at least two contact points are formed when the male contact is coupled to the female receptacle.

5. The electrical connector of claim 1 wherein the internal cavity has a cross-section greater than the cross-section of the passage.

6. The electrical connector of claim 1 wherein a wire coupled to the female contact for permitting electrical current flow substantially fills an opening of the female contact housing and prevents airflow through the opening at an inner end of the cavity opposite the passage.

7. An electrical connector assembly to extinguish an electrical arc that is created by separation of electrical connectors comprising:

a male connector having at least one male prong;

a female connector defined by a housing having at least one internal cavity to carry at least one female receptacle configured to couple with the at least male prong and at least one passage that extends from an outer end of the cavity to an exterior surface defined by the housing;

wherein an outer end of the at least one female receptacle extends to an outer end of the cavity adjacent the passage that is configured to receive the at least one male prong;

wherein the at least one male prong is movable inwardly through the passage for engagement with the outer end of the at least one female receptacle and is movable outward through the passage upon disengagement with the outer end of the at least one female receptacle; and wherein the passage has a cross-section defining an area configured similarly to and slightly larger than the cross-section of the at least one male prong to define a constriction within the passage when the at least one male prong is present within the passage wherein in the event an electrical arc is created by disengagement of the at least one male prong with an open outer end of the at least one female receptacle, air contained within the internal cavity is heated by the electrical arc and creates pressure within the internal cavity that forces air outwardly through the constriction in the passage to extinguish the electrical arc.

8. The electrical connector assembly of claim 7 wherein the male connector is a power cord plug.

9. The electrical connector assembly of claim 7 wherein the female connector is a power cord socket.

10. The electrical connector assembly of claim 7 wherein the at least one female receptacle comprises a pair of female receptacles housed within separate internal cavities.

11. The electrical connector assembly of claim 7 wherein the cross-section of the passage is less than the cross-section of the internal cavity.

12. A method of extinguishing an electrical arc of an electrical connector assembly comprising the steps of:

providing an electrical connector assembly comprising a male contact, a female contact configured to couple with the male contact, and a housing having an internal cavity within which the female contact is contained and further having a passage that extends from an outer end of the cavity to an exterior surface defined by the housing;

moving the male contact inwardly through the passage to seal air within the housing;

engaging the male contact with an open outer end portion of the female contact thereby allowing an electric current to flow between the male contact and the female contact;

disengaging the male contact from the open outer end of the female contact thereby creating an electrical arc which heats the air within the internal cavity and creates a pressure build up; and moving the male contact outwardly through the passage upon disengagement with the open outer end of the female contact to remove the male contact from the housing and forcing pressurized air outwardly through the constricted passage to extinguish the electrical arc.

13. The method of extinguishing an electrical arc of claim 12 wherein the open outer end portion of the female contact is located toward an outer end of the cavity.

14. The method of extinguishing an electrical arc of claim 12 wherein the passage has a cross-section defining an area configured similarly to and slightly larger than a cross section defined by the male contact.

15. The method of extinguishing an electrical arc of claim 12 wherein a cross-section of the passage is smaller than a cross-section of the cavity.

16. The method of extinguishing an electrical arc of claim 12 wherein a wire coupled to the female contact for permitting electrical current flow substantially fills an opening of the female contact housing and prevents airflow through the opening at an inner end of the cavity opposite the passage.

17. The method of extinguishing an electrical arc of claim 12 wherein the male contact is a flat blade plug.

18. The method of extinguishing an electrical arc of claim 12 wherein the female contact has dual undulating contacts.

* * * * *